US007284624B2

(12) United States Patent
Tjader

(10) Patent No.: US 7,284,624 B2
(45) Date of Patent: Oct. 23, 2007

(54) DRILL GRIPPING DEVICE AND METHOD

(75) Inventor: Michael Tjader, New Richmond, WI (US)

(73) Assignee: IT Technologies, Inc., Aurora, IL (US)

( * ) Notice: Subject to any disclaimer, the term of this patent is extended or adjusted under 35 U.S.C. 154(b) by 279 days.

(21) Appl. No.: 10/754,221

(22) Filed: Jan. 9, 2004

(65) Prior Publication Data

US 2004/0256156 A1 Dec. 23, 2004

Related U.S. Application Data

(60) Provisional application No. 60/439,936, filed on Jan. 14, 2003.

(51) Int. Cl.
*E21B 19/16* (2006.01)

(52) U.S. Cl. ..... 175/85; 81/57.34; 81/57.19; 166/77.53

(58) Field of Classification Search ..... 175/85; 166/77.53; 81/57.34, 57.19; 61/57.16, 57.2, 61/57.21

See application file for complete search history.

(56) References Cited

U.S. PATENT DOCUMENTS 4,403,666 A * 9/1983 Willis ..... 175/85
4,703,811 A * 11/1987 Lam ..... 173/28
4,732,061 A 3/1988 Dinsdale ..... 81/57.34
4,843,945 A * 7/1989 Dinsdale ..... 81/57.34
5,388,652 A 2/1995 Smith ..... 175/85
5,520,072 A * 5/1996 Perry ..... 81/57.16
6,752,043 B2 * 6/2004 Carlson ..... 81/57.16
2002/0157870 A1 * 10/2002 Bischel et al. ..... 175/52

OTHER PUBLICATIONS

EU Search Report for International Application No. PCT/US2004/000587, (May 13, 2004), 3 pgs.

* cited by examiner

*Primary Examiner*—Hoang Dang
(74) *Attorney, Agent, or Firm*—Schwegman, Lundberg & Woessner, P.A.

(57) ABSTRACT

A drill gripping device is shown with an inexpensive and compact design. In one embodiment, an inexpensive and more compact design is possible through the use of a single actuator with a single gripping portion of a drill gripping device. Embodiments of drill gripping devices shown are further reduced in price and size due to a force amplification device such as a camming arm. Alternatively, an increased gripping force is possible using an existing size actuator. A drill gripping device is shown with increased precision in gripping. A pair of gripping jaws are synchronized to improve jaw centering capabilities.

20 Claims, 7 Drawing Sheets

DRILL GRIPPING DEVICE AND METHOD

This application claims priority to U.S. Provisional Application No. 60/439,936 filed on Jan. 14, 2003.

TECHNICAL FIELD

This invention relates to gripping devices. Specifically, this invention relates to devices for gripping drill rods for use in ground drilling.

BACKGROUND

Devices such as directional drills are used in industry to bore openings underground for pipes, cables, etc. Directional drills typically use a number of sections to form a drill stem. The sections are inserted one at a time during a forward drilling operation, and are removed one at a time after the bore has reached a desired depth in order to remove the drill stem from the bore. Although an example of a directional drill is used in the following descriptions, other ground drills utilizing a number of sections of drill stem are also contemplated to be within the scope of the invention.

Sections of drill stem are typically joined together using a mating threaded joint. In this configuration, several sections of drill stem can be housed in a small space, for example in a hopper on a drill device. Drilling devices such as a directional drill are configured with gripping devices to selectively hold the sections of drill stem during a joining or detaching operation to add or remove sections of the drill stem.

A problem with current gripping device designs is that they are large and cumbersome. Existing configurations use a pair of hydraulic cylinders for a single drill gripping device, which is expensive to manufacture, and adds size and weight to a cumbersome drilling device. Further, existing drill gripping devices do not center well on a section of drill stem during a gripping operation. A poorly centered gripping device leads to excessive wear of gripping jaws, among other problems.

What is needed is a drill gripping device that is smaller and less expensive to manufacture. What is also needed is a drill gripping device with improved operation characteristics such as extended jaw life.

SUMMARY

The above mentioned concerns including, but not limited to, manufacturing considerations, size, and extending jaw life are addressed by the present invention and will be understood by reading and studying the following specification.

A drill gripping device is shown. In one embodiment, the drill gripping device includes a pair of gripping jaws, and a single actuating device coupled to the pair of gripping jaws. In one embodiment, the drill gripping device further includes a force amplifying linkage coupled between the single actuating device and the a pair of gripping jaws. In one embodiment, the drill gripping device further includes a connecting portion, wherein the pair of jaws are connected to move together.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION

Figure 1A:
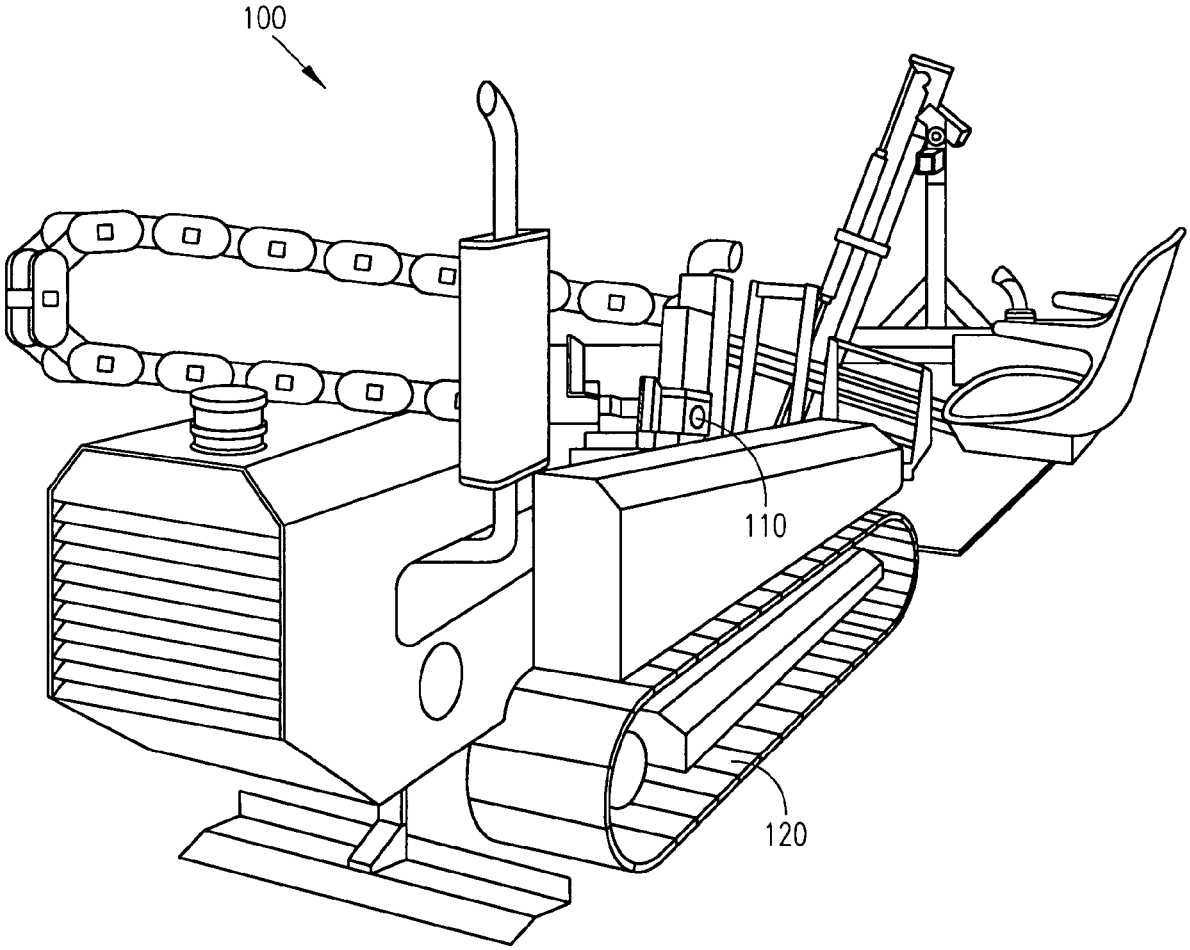
FIG. 1A shows a drilling device according to an embodiment of the invention.

In the following detailed description, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, or logical changes, etc. may be made without departing from the scope of the present invention.

FIG. 1A shows a drilling device. As discussed above, although an example of a directional drill 100 is used in the following descriptions, other ground drills utilizing a number of sections of drill stem are also contemplated to be within the scope of the invention. The directional drill 100 of FIG. 1A is shown on a track system 120 for positioning the directional drill 100. Although a track system 120 is shown, other systems are also possible for use in positioning the directional drill 100. Wheeled systems, or combinations of tracked and wheeled systems are examples of acceptable positioning systems. Although a positioning system is shown in the embodiment of FIG. 1A, the invention is not so limited. Embodiments without a positioning system are also possible.

A drilling drive block 110 is shown on the directional drill 100. The drilling drive block 110 is used to rotate a drill stem and to advance the drill stem during a drilling operation. Advancement of a drill stem is typically linear. In the example of a directional drill 100, the advancement of the drill stem is also typically at an angle of incidence to the ground as shown in FIG. 1A.

Figure 1B:
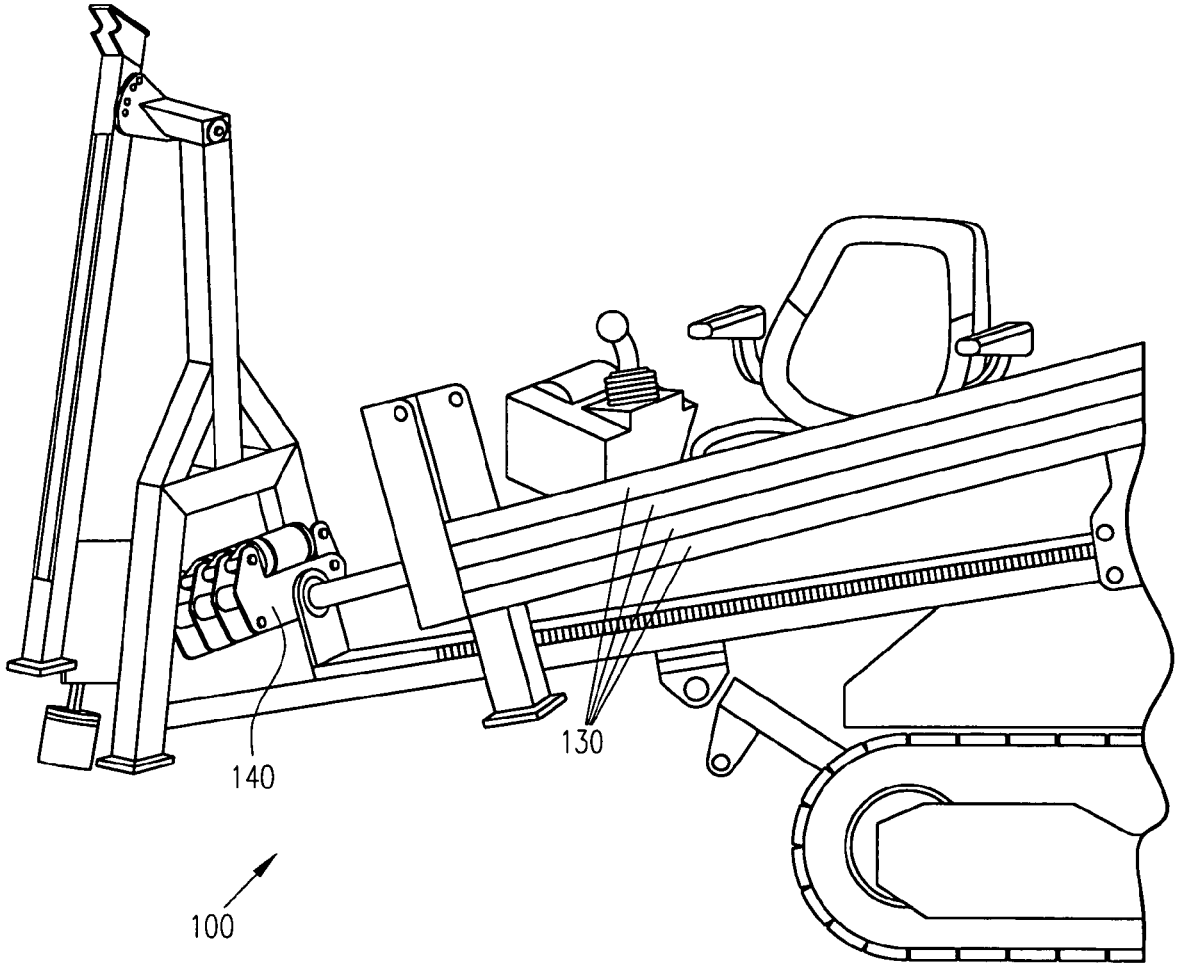
FIG. 1B shows a side view of a front portion of a drilling device according to an embodiment of the invention.

FIG. 1B shows the directional drill 100. A storage area or hopper 130 is shown for housing sections of drill stem as shown. In one embodiment, as shown in FIG. 1B, a drill gripping device 140 is located near a front portion of the directional drill 100. The drill gripping device 140 is useful during installation of sections of drill stem during forward drilling operations and for removal of sections of drill stem during extraction of the drill stem.

Figure 1C:
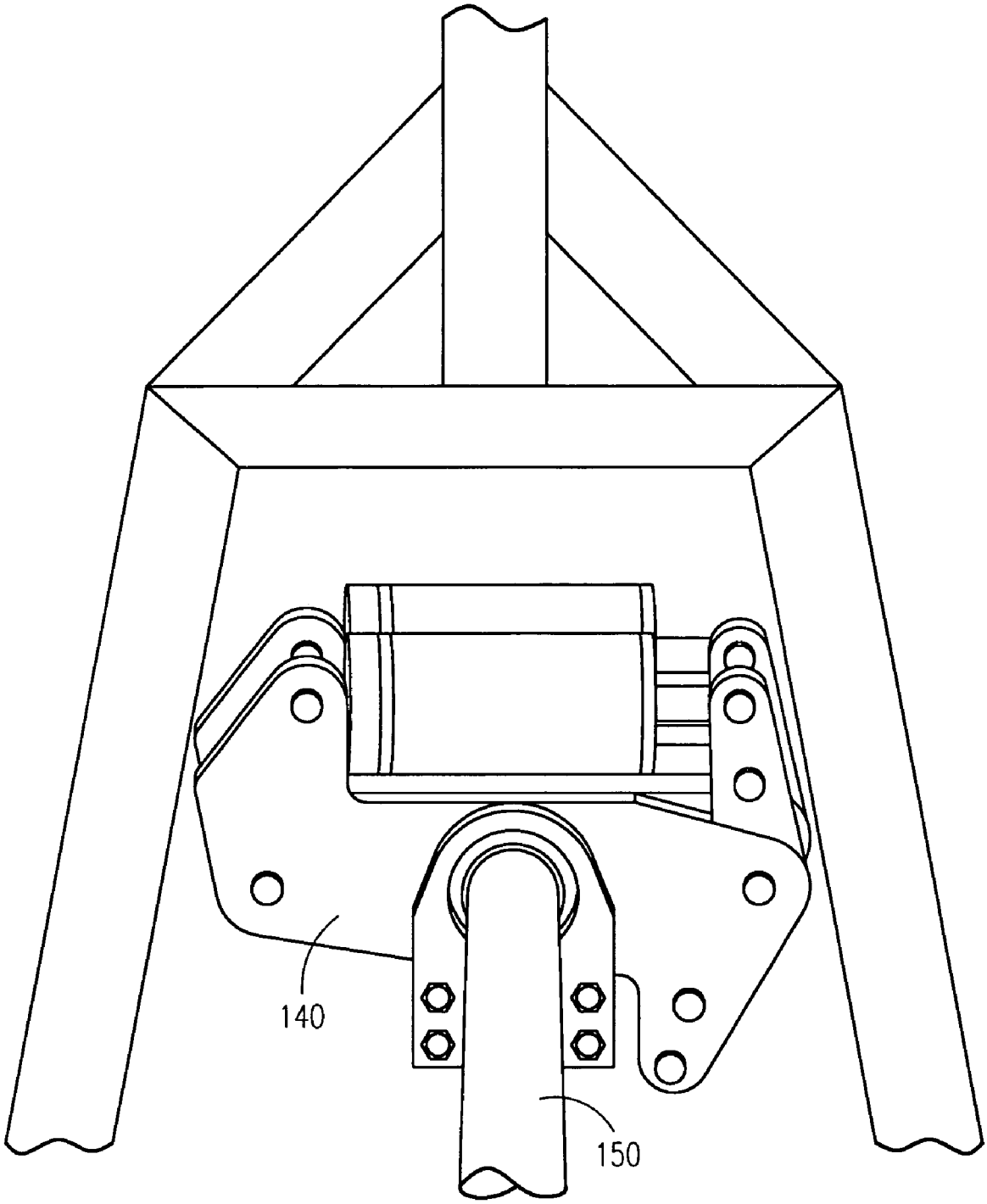
FIG. 1C shows a portion of a drilling device according to an embodiment of the invention.

FIG. 1C shows a closer view of the drill gripping device 140. A section of drill stem 150 is shown passing through a portion of the drill gripping device 140. When at least a portion of the drill gripping device 140 is actuated, the drill stem 150 is held in place from both linear advancing motion and from rotational motion about the long axis of the drill stem.

Figure 2A:
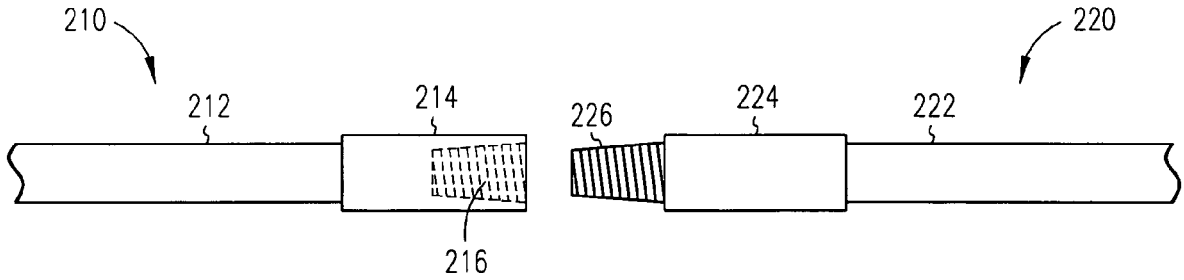
FIG. 2A shows two sections of a drill stem according to an embodiment of the invention.
Figure 2B:
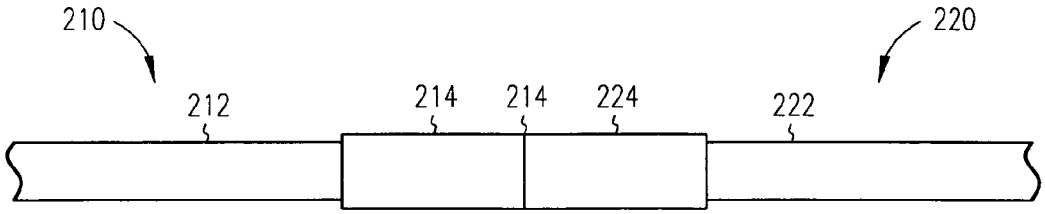
FIG. 2B shows a mating joint of two sections of a drill stem according to an embodiment of the invention.

FIG. 2A shows a portion of a first section of drill stem 210 and a portion of a second section of drill stem 220. As noted above, a drill stem is typically made up of a number of sections similar to the first section 210 and the second section 220 as shown in FIGS. 2A and 2B. The number of sections in a particular drill stem depends on the depth or distance of the bore being drilled. In FIG. 2A, the portion of the first section of drill stem 210 includes a length 212 and a coupling portion 214. In FIG. 2A, the coupling portion 214 includes a female coupling portion. In one embodiment, the female coupling portion 214 includes a tapered female thread portion 216. The tapered thread aids in making a firm connection between sections of drill stem.

In one embodiment, the coupling portion 214 is formed from a hardened steel material to resist gripping or clamping damage. In one embodiment, the length portion is formed from a different material than the coupling portion 214. In one embodiment, the length portion is formed from a less expensive material than the coupling portion 214. In one embodiment, the length portion is formed from a mild steel material. Because the length portion is typically not used as a gripping or clamping surface, a softer steel can be used for advantages such as reduced cost in the drill stem sections.

In FIG. 2A, the portion of the second section of drill stem 220 includes a length 222 and a coupling portion 224. In FIG. 2A, the coupling portion 224 includes a male coupling portion. In one embodiment, the male coupling portion 224 includes a tapered male thread portion 226. The male tapered thread portion 226 is adapted to join with the female tapered thread portion 216 of the portion of the first section of drill stem 210.

FIG. 2B shows the first section of drill stem 210joined to the second section of drill stem 220 at a joint 230. Embodiments of the present invention are adapted to assist in coupling and uncoupling joints 230 as shown in FIGS. 2A and 2B.

Figure 3A:
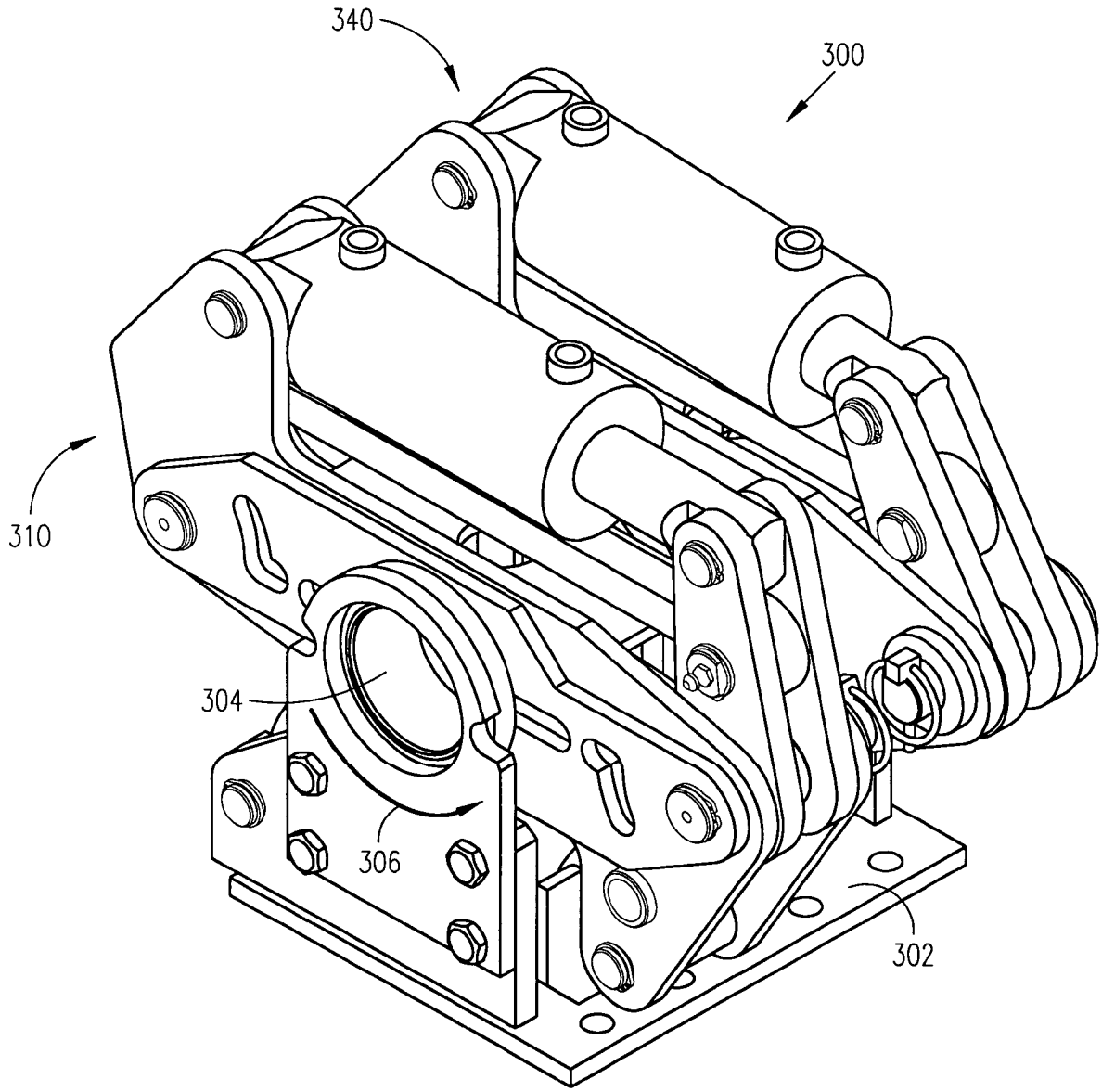
FIG. 3A shows an isometric view of a drill gripping device according to an embodiment of the invention.

FIG. 3A shows a drill gripping device 300 similar to embodiments shown in Figures above. In one embodiment, the drill gripping device 300 includes a first gripping portion 310 and a second gripping portion 340. In one embodiment, the first gripping portion 310 and the second gripping portion 340 are mounted to a base 302. In one embodiment, the gripping device 300 includes an opening 304 that is sized to accept a section of a drill stem (not shown). In one embodiment, the opening 304 includes a hole that passes through the first gripping portion 310 and the second gripping portion 340. In one embodiment, the first gripping portion 310 is adapted to rotate relative to the second gripping portion 340 when actuated by an actuator. Relative motion is indicated by arrow 306.

Figure 3B:
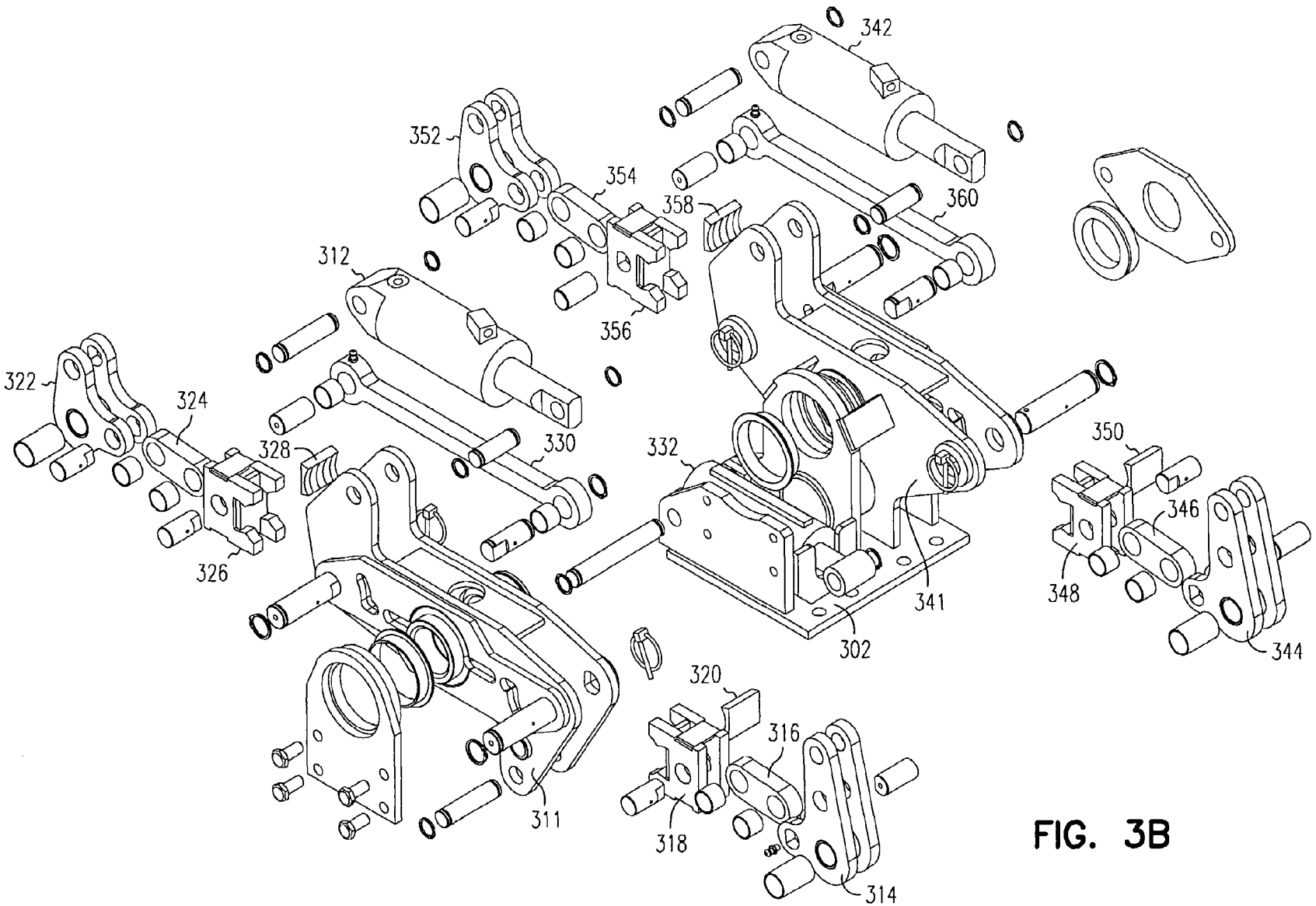
FIG. 3B shows an exploded view of a drill gripping device according to an embodiment of the invention.

FIG. 3B shows a detailed view of components of one embodiment of the drill gripping device 300. The first gripping portion 310 includes a first actuator 312 that is coupled to a first rocker arm 314, that is coupled to a first camming linkage 316. The first camming linkage 316 is coupled in turn to a first jaw carrier 318 that is adapted for holding a first gripping jaw 320. Although one embodiment includes a gripping jaw that is separate and detachable from a jaw carrier, other embodiments may include an integrally formed jaw carrier and gripping jaw.

A second rocker arm 322, is coupled to a second camming linkage 324. The second camming linkage 324 is coupled in turn to a second jaw carrier 326 that is adapted for holding a second gripping jaw 328. In one embodiment, the first rocker arm 314 is coupled to the second rocker arm 322 through a connecting portion 330. The connecting portion acts to synchronize motion of the first and second jaw carriers 318 and 326, and consequently the first and second gripping jaws 320 and 328.

The second gripping portion 340 includes a second actuator 342 that is coupled to a third rocker arm 344, that is coupled to a third camming linkage 346. The third camming linkage 346 is coupled in turn to a third jaw carrier 348 that is adapted for holding a third gripping jaw 350. Although one embodiment includes a gripping jaw that is separate and detachable from a jaw carrier, other embodiments may include an integrally formed jaw carrier and gripping jaw.

A fourth rocker arm 352, is coupled to a fourth camming linkage 354. The fourth camming linkage 354 is coupled in turn to a fourth jaw carrier 356 that is adapted for holding a fourth gripping jaw 358. In one embodiment, the third rocker arm 344 is coupled to the fourth rocker arm 352 through a connecting portion 360. The connecting portion acts to synchronize motion of the third and fourth jaw carriers 348 and 356, and consequently the third and fourth gripping jaws 350 and 358.

In one embodiment components of the second gripping device 340 are coupled together or related to one another by a second frame 341. Similarly, in one embodiment components of the first gripping device 310 are coupled together or related to one another by a first frame 311. In one embodiment, a third actuator 332 is coupled between the base 302 and the first frame 311 of the first gripping portion 310. The third actuator 322 drives rotational motion of the first gripping device 310 relative to the base 302, resulting in relative rotational motion of the first gripping device 310 relative to the second gripping device 340 when the third actuator 332 is actuated.

In one embodiment, actuators such as the first actuator 312, the second actuator 342 and the third actuator 332 include hydraulic cylinders. Although hydraulic cylinders are shown, other embodiments include, but are not limited to, actuators such as electric motors, pneumatic devices, solenoids, etc.

Figure 4:
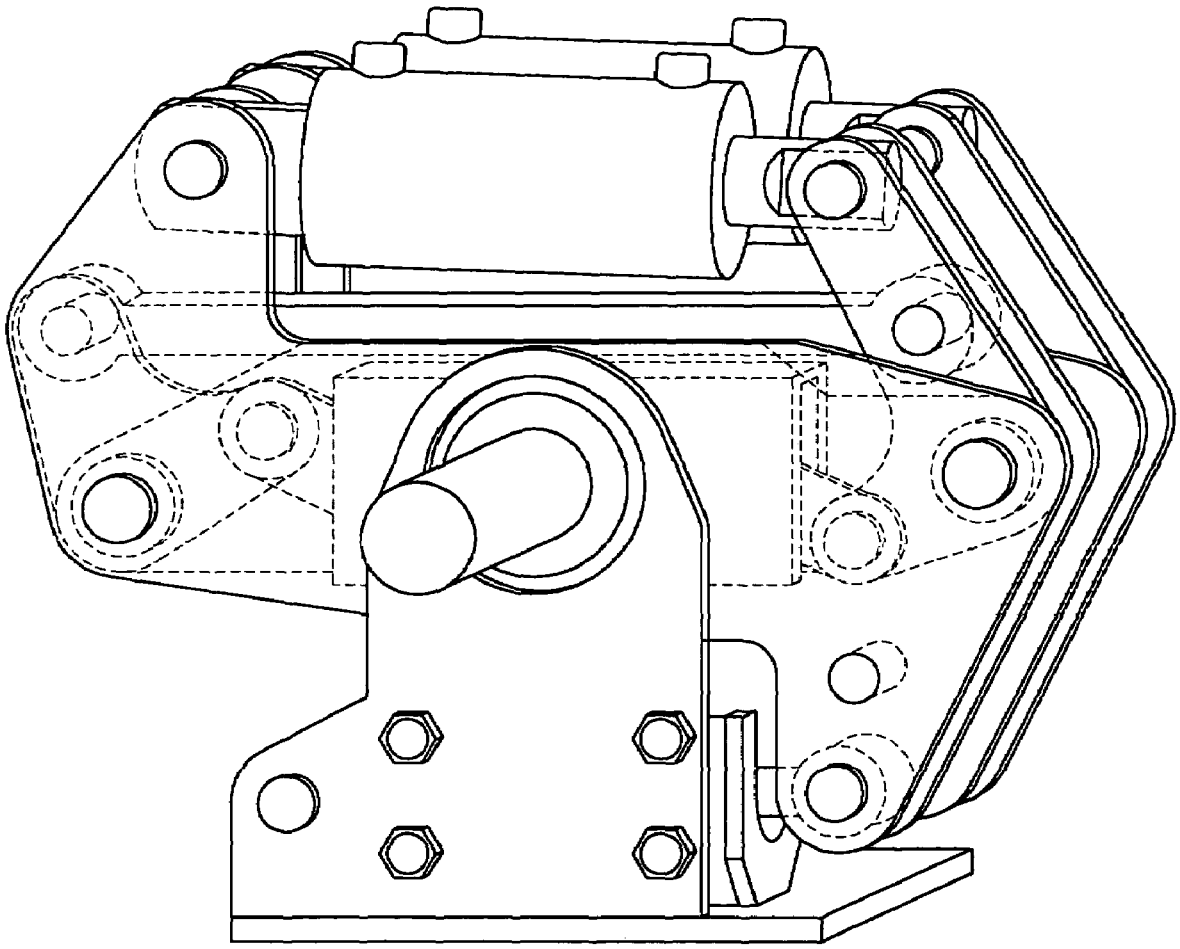
FIG. 4 shows an isometric view of a drill gripping device according to an embodiment of the invention.

FIG. 4 shows an embodiment of a drill gripping device with a number of components shown as transparent. Interactions of a number of linkage components can be more easily identified in this Figure.

Embodiments of drill gripping devices as described above are useful for gripping a first coupling portion of a section of a drill stem, concurrently gripping a second coupling portion of a section of drill stem, and twisting one coupling portion of a section of a drill stem relative to the other coupling portion. The twisting motion is used to "break" the threaded joint allowing the two sections of drill stem to then be disassembled using conventional unscrewing methods.

The configurations of drill gripping devices described above have a number of advantages. Each gripping portion is designed with a single actuator. This configuration is less expensive to manufacture than prior configurations, and it is also smaller and more compact than prior configurations. Further, through the use of force amplifying devices, including but not limited to camming arms, a smaller actuator is possible. Again, this configuration is less expensive to manufacture, and is smaller and more compact due to the ability to use a smaller, less powerful actuator. Another advantage of the configurations of drill gripping devices described above is that the gripping jaws are actuated with more precision than prior designs.

Designs that used a separate actuator for each gripping jaw have a condition where the jaws do not always center correctly on a section of drill stem. In multiple actuator designs, the individual actuators are designed with a long travel stroke in order to compensate for possible misalignment with the drill stem. This imprecise design leads to two problems that are addressed by embodiments of the present invention. Misalignment of gripping jaws in prior designs led to premature gripping jaw wear. Further, in prior designs, due to the longer actuator stroke it was possible to damage the softer length portions of drill stem as described in FIGS. 2A and 2B.

In contrast, embodiments of the present invention as described above, have improved precision and centering capabilities. One feature that facilitates the improved precision of embodiments of the invention includes the connecting portions 330 and 360. The connecting portions synchronize a pair of rocker arms, which in turn synchronize a pair of gripping jaws in a respective gripping portion such as the first gripping portion 310 or the second gripping portion 340.

Improved centering further allows the travel strokes of gripping jaws in embodiments of described above to be more limited. Limited travel strokes of the gripping jaws allows design of drill gripping devices where damage to the softer length portions of sections of drill stem is eliminated. The gripping jaws grip precisely on larger diameter, hardened steel connecting portions, but are not allowed to travel far enough to damage the smaller diameter length portions.

CONCLUSION

Embodiments of drill gripping devices described above have advantages such as an inexpensive and compact design. In one embodiment, an inexpensive and more compact design is possible through the use of a single actuator with a single gripping portion of a drill gripping device. Embodiments of drill gripping devices described above are further reduced in price and size due to a force amplification device such as a camming arm. Alternatively, an increased gripping force is possible using an existing size actuator.

Embodiments of drill gripping devices described above also include advantages such as increased precision in gripping. Features such as a connecting portion coupled between gripping jaws synchronizes gripping jaw motion to improve jaw centering capabilities. Improved jaw centering and/or increased gripping force allows the gripping jaws to get a better "bite" on connecting portions and reduces jaw slippage. Reduced jaw slippage in turn reduces jaw wear.

Further, increased precision in gripping permits designs of drill gripping devices that do not damage softer, smaller diameter length section of drill stem sections.

While a number of advantages of embodiments of the invention are described, the above lists are not intended to be exhaustive. Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A drill gripping device, comprising:

a pair of gripping jaws;

a single actuating device coupled to the pair of gripping jaws;

a force amplifying linkage coupled between the single actuating device and the pair of gripping jaws, wherein the force amplifying linkage includes:

a first camming linkage pivotally coupled between a first rocker and a first gripping jaw, and a second camming linkage pivotally coupled between a second rocker and a second gripping jaw;

wherein full extension of the first camming linkage and the second camming linkage results in a jaw spacing that is smaller than a diameter of a drill stem coupling portion and larger than a diameter of a middle of a drill stem section; and a connecting portion, wherein the pair of jaws are connected to move together.

2. The drill gripping device of claim 1, further including a pair of jaw carriers to hold the pair of gripping jaws, wherein the pair of gripping jaws are removable for replacement.

3. The drill gripping device of claim 1, wherein the single actuating device includes a single hydraulic cylinder.

4. The drill gripping device of claim 1, wherein the single actuating device is coupled with the first rocker, and the connecting portion is coupled between the first rocker and the second rocker.

5. A drill rod system, comprising:

two sets of drill gripping devices including a first drill gripping device and a second drill gripping device, wherein at least one drill gripping device includes:

a pair of gripping jaws;

a single actuating device coupled to the pair of gripping jaws;

a force amplifying linkage coupled between the single actuating device and the pair of gripping jaws, wherein the pair of gripping jaws move in a range of motion sufficient to grip only a coupling portion of a drill stem, and the gripping jaws are substantially prevented from gripping a narrower portion of the drill stem;

a connecting portion, wherein the pair of jaws are connected to move together;

a pivot joint that allows the first drill gripping device to rotate relative to the second drill gripping device; and a device rotation actuator to control motion of the first drill gripping device relative to the second drill gripping device.

6. The drill rod system of claim 5, wherein the single actuating device includes a single hydraulic cylinder.

7. The drill rod system of claim 5, wherein the device rotation actuator includes a hydraulic cylinder.

8. The drill rod system of claim 5, wherein the two sets of drill gripping devices both include:

a pair of gripping jaws;

a single actuating device coupled to the pair of gripping jaws;

a force amplifying linkage coupled between the single actuating device and the pair of gripping jaws; and a connecting portion, wherein the pair of jaws are connected to move together.

9. A drilling device, comprising:

a linear drive region with a linear range of motion;

a drilling drive block movable within the linear range of motion;

a drill stem rotation device located on the drilling drive block;

a drill gripping device located at an end of the linear range of motion, including:

a pair of gripping jaws;

a single actuating device coupled to the pair of gripping jaws;

a force amplifying linkage coupled between the single actuating device and the pair of gripping jaws, wherein the force amplifying linkage includes:

a first camming linkage pivotally coupled between a first rocker and a first gripping jaw, and a second camming linkage pivotally coupled between a second rocker and a second gripping jaw;

wherein full extension of the first camming linkage and the second camming linkage results in a jaw spacing that is smaller than a diameter of a drill stem coupling portion and larger than a diameter of a middle of a drill stem section; and a connecting portion, wherein the pair of jaws are connected to move together.

10. The drilling device of claim 9, further including a pair of jaw carriers to hold the pair of gripping jaws, wherein the pair of gripping jaws are removable for replacement.

11. The drilling device of claim 9, wherein the single actuating device includes a single hydraulic cylinder.

12. The drilling device of claim 9, wherein the single actuating device is coupled with the first rocker, and the connecting portion is coupled between the first rocker and the second rocker.

13. A drilling device, comprising:

a linear drive region with a linear range of motion;

a drilling drive block movable within the linear range of motion;

a drill stem rotation device located on the drilling drive block;

two sets of drill gripping devices located at an end of the linear range of motion, including a first drill gripping device and a second drill gripping device, wherein the drill gripping devices each include:

a pair of gripping jaws;

a single actuating device coupled to the pair of gripping jaws;

a force amplifying linkage coupled between the single actuating device and the pair of gripping jaws, wherein the pair of gripping jaws move in a range of motion sufficient to grip only a coupling portion of a drill stem, and the gripping jaws are substantially prevented from gripping a narrower portion of the drill stem;

a connecting portion, wherein the pair of jaws are connected to move together;

a pivot joint that allows the first drill gripping device to rotate relative to the second drill gripping device; and a device rotation actuator to control motion of the first drill gripping device relative to the second drill gripping device.

14. The drilling device of claim 13, further including a storage area to hold sections of drill stem and a handling device to move sections of drill stem between the storage area and the drilling drive block.

15. The drilling device of claim 13, further including a track system for positioning of the drilling device on a drilling site.

16. The drilling device of claim 13, wherein the end of the linear range of motion includes an end of the linear range of motion that is adjacent to a front end of drilling device.

17. A method, comprising:

actuating a first single actuator in a first drill gripping device to grip a first section of drill stem, wherein the first drill gripping device has a range of motion sufficient to grip only a coupling portion of the first section, and the first drill gripping device is substantially prevented from gripping a narrower portion of the first section;

actuating a second single actuator in a second drill gripping device to grip a second section of drill stem, wherein the second drill gripping device has a range of motion sufficient to grip only the coupling portion of the second section, and the second drill gripping device is substantially prevented from gripping a narrower portion of the second section; and actuating a device rotation actuator and rotating the first drill gripping device with respect to the second drill gripping device to loosen a threaded connection between the first section of drill stem and the second section of drill stem.

18. The method of claim 17, wherein actuating the first single actuator includes actuating a first single actuator coupled to a pair of gripping jaws through a force amplifying linkage.

19. The method of claim 18, wherein actuating the first single actuator includes actuating a first single actuator coupled to a pair of gripping jaws that are connected to move together.

20. The method of claim 17, wherein actuating the first single actuator, actuating the second single actuator, and actuating the device rotation actuator includes actuating a first single hydraulic cylinder, actuating a second hydraulic cylinder, and actuating a hydraulic device rotation cylinder.

* * * * *

UNITED STATES PATENT AND TRADEMARK OFFICE

CERTIFICATE OF CORRECTION

PATENT NO. : 7,284,624 B2 
APPLICATION NO. : 10/754221
DATED : October 23, 2007
INVENTOR(S) : Tjader It is certified that error appears in the above-identified patent and that said Letters Patent is hereby corrected as shown below:

On the Title page, in field (73), in "Assignee", in column 1, line 1, delete "IT Technologies" and insert -- TT Technologies --, therefor.

Signed and Sealed this

Twenty Second Day of April, 2008

JON W. DUDAS
*Director of the United States Patent and Trademark Office*